US008793893B2

(12) United States Patent
Bae et al.

(10) Patent No.: US 8,793,893 B2
(45) Date of Patent: Aug. 5, 2014

(54) APPARATUS FOR TREATING CLOTHES AND METHOD FOR CONTROLLING THE SAME

(75) Inventors: Sang Hun Bae, Changwon-si (KR); Jung Wook Moon, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 393 days.

(21) Appl. No.: 12/309,824

(22) PCT Filed: Aug. 1, 2007

(86) PCT No.: PCT/KR2007/003708

§ 371 (c)(1),
(2), (4) Date: Jan. 30, 2009

(87) PCT Pub. No.: WO2008/016261

PCT Pub. Date: Feb. 7, 2008

(65) Prior Publication Data

US 2009/0320317 A1 Dec. 31, 2009

(30) Foreign Application Priority Data

Aug. 2, 2006 (KR) ..... 10-2006-0072897

(51) Int. Cl.
*F26B 25/18* (2006.01)
*F26B 11/02* (2006.01)

(52) U.S. Cl.
USPC ..... 34/192; 34/198; 34/603

(58) Field of Classification Search
USPC ..... 34/282, 90, 603, 601, 604, 443, 448, 34/452, 58, 318, 319, 201, 202, 381, 406, 34/407, 408, 275, 312–317, 195, 192, 34/198; 68/23.5, 5 C; 4/661
See application file for complete search history.

(56) References Cited

U.S. PATENT DOCUMENTS

| | | | | |
|---|---|---|---|---|
| 4,999,124 | A | 3/1991 | Copeland | |
| 5,307,651 | A * | 5/1994 | Felzer | 68/23.5 |
| 7,418,789 | B2 * | 9/2008 | Choi et al. | 34/380 |
| 7,597,116 | B2 * | 10/2009 | Detwiler | 137/899.2 |
| 7,665,417 | B1 * | 2/2010 | Harper | 119/51.01 |

(Continued)

FOREIGN PATENT DOCUMENTS

| | | | |
|---|---|---|---|
| DE | 43 04 532 | A1 | 8/1994 |
| DE | 10332656 | A1 * | 7/2004 |

(Continued)

*Primary Examiner* — Kenneth Rinehart
*Assistant Examiner* — John McCormack
(74) *Attorney, Agent, or Firm* — McKenna Long & Alridge LLP

(57) ABSTRACT

An apparatus for treating clothes and a method for controlling the same, which are capable of controlling or preventing formation of creases on clothes, are disclosed. The disclosed apparatus includes a drum (20), a steam generator (200) to supply steam to the drum (20), a water container (300) to store water to be supplied to the steam generator (200), the water container (300) detachable, a sensor (500) to sense whether the water container (300) is detached or attached, a water supplier (400) to supply the water stored in the water container (300) to the steam generator (200), and a controller to control an operation of the water supplier (400) based on a sensing result of the sensor (500).

11 Claims, 5 Drawing Sheets

(56) References Cited

U.S. PATENT DOCUMENTS

| | | | | |
|---|---|---|---|---|
| 8,161,870 | B2 * | 4/2012 | Yamamoto et al. | 99/330 |
| 8,327,672 | B2 * | 12/2012 | Hill | 68/17 R |
| 2005/0115120 | A1 * | 6/2005 | Cevik | 38/14 |
| 2006/0016020 | A1 | 1/2006 | Park | |
| 2006/0277690 | A1 * | 12/2006 | Pyo et al. | 8/149.2 |
| 2007/0271938 | A1 * | 11/2007 | Shaffer | 62/228.1 |
| 2009/0235465 | A1 * | 9/2009 | Klug et al. | 8/149.3 |

FOREIGN PATENT DOCUMENTS

| | | | | |
|---|---|---|---|---|
| EP | 1464750 | A1 | | 10/2004 |
| JP | 02255198 | A | * | 10/1990 |
| JP | 06074485 | A | * | 3/1994 |
| KR | 2004-0105343 | | | 12/2004 |
| KR | 10-2005-0018183 | | | 2/2005 |
| KR | 10-0698133 | | | 3/2007 |

* cited by examiner

APPARATUS FOR TREATING CLOTHES AND METHOD FOR CONTROLLING THE SAME

This application is a national stage entry of International Application No. PCT/KR2007/003708, filed Aug. 1, 2007, and claims the benefit of Korean Application No. 10-2006-0072897, filed in Korea on Aug. 2, 2006, and is hereby incorporated by reference for all purposes as if fully set forth herein.

TECHNICAL FIELD

The present invention relates to an apparatus for treating clothes and a method for controlling the same, and more particularly, to an apparatus for treating clothes and a method for controlling the same, which are capable of controlling or preventing formation of creases on clothes.

BACKGROUND ART

Generally, clothes treating apparatuses include a washing machine, a drying machine, and a washing machine having a drying function (hereinafter, referred to as a "washing/drying machine"). The washing machine is an apparatus for removing dirt or contaminants attached to laundry in accordance with a chemical dissolution function and a mechanical impact function. The drying machine is an apparatus for supplying hot air to objects to be dried, to dry the objects. Recently, the use of the washing/drying machine, which has both the washing function and the drying function, has been increased.

Typically, such a clothes treating apparatus includes a drum for accommodating clothes therein, and a drive source for driving the drum. In the case of a drying machine, it includes, in addition to the above-mentioned elements, a heater for heating air introduced into the drum, and a blower unit for sucking air into the drum or outwardly discharging air from the drum.

Drying machines may be classified into an electric type and a gas type in accordance with the type of the system for heating air, namely, the type of the heater. The electric type drying machine heats air, using heat generated from an electrical resistance. On the other hand, the gas type drying machine heats air, using heat generated in accordance with the combustion of gas.

Drying machines may also be classified into a condensation type and an exhaustion type. In the condensation type drying machine, air, which has become humid after being heat-exchanged with an object to be dried, is circulated without being outwardly discharged, specifically, exhausted. The air is heat-exchanged with ambient air through a separate condenser. In accordance with this heat exchange, condensed water is generated, and is then outwardly discharged. In the exhaustion type drying machine, air, which has become humid after being heat-exchanged with an object to be dried, is directly discharged to the outside of the drying machine.

In accordance with the system for loading objects, to be dried, drying machines may also be classified into a top loading type and a front loading type. In the top loading type drying machine, objects are loaded into the drying machine through the top side of the drying machine. On the other hand, in the front loading type drying machine, objects are loaded into the drying machine through the front side of the drying machine.

However, the above-mentioned conventional drying machines have the following problems.

Typically, in a drying machine, laundry spin-dried after being completely washed is loaded so that it can be dried. In this case, the laundry, which has been washed using water, has creases due to the principle of the water washing. In the drying procedure, however, the creases cannot be completely removed.

In order to remove the creases still present on objects, such as laundry, completely dried in conventional drying machines, it is necessary to perform ironing. In order to solve this problem, the development of a drying machine provided with a steam supplier has been required. In this connection, it is also necessary to develop additional devices for achieving a smooth operation and a desired durability of the drying machine, in spite of the installation of the steam supplier.

DISCLOSURE OF INVENTION

Technical Problem

The present invention has been made in view of the above-mentioned problems, and an object of the present invention is to provide an apparatus for treating clothes and a method for controlling the same, which are capable of controlling and/or preventing formation of creases on clothes.

Technical Solution

In one aspect of the present invention, an apparatus for treating clothes comprises: a drum; a steam generator to supply steam to the drum; a water container to store water to be supplied to the steam generator, the water container detachable; a sensor to sense whether the water container is detached or attached; a water supplier to supply the water stored in the water container to the steam generator; and a controller to control an operation of the water supplier based on a sensing result of the sensor.

In another aspect of the present invention, a drying machine comprises: a drum; a hot air supplier to supply hot air to the drum; a steam generator to supply steam to the drum; a water container to store water to be supplied to the steam generator, the water container detachable; a sensor to sense whether the water container is detached or attached; a water supplier to supply the water stored in the water container to the steam generator; and a controller to control an operation of the water supplier based on a sensing result of the sensor.

Preferably, the water supplier comprises a pump. The pump may be arranged in a water supply line connecting the steam generator and the water container.

In this case, preferably, the controller controls the pump to operate for a pre-determined time when the detachment of the water container is sensed by the sensor. Accordingly, it is possible to prevent residual water, which remains in the water supply line upon the detachment of the water container from the pump, from leaking.

The sensor may comprise an on/off switch, which turns on or off based on a connection or disconnection between the pump and the water container, or may comprise a sensor capable of sensing a connection or disconnection between the pump and the water container.

In still another aspect of the present invention, a method for controlling a clothes treating apparatus including a steam generator to supply steam to the drum, a water container to store water to be supplied to the steam generator, the water container detachable, and a pump to supply the water stored in the water container to the steam generator comprises: sensing whether the water container is detached or attached; and controlling an operation of the pump based on the sensed result.

Preferably, the controlling step comprises controlling the pump to operate for a pre-determined time when the water container is detached.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Preferred embodiments of a drying machine as an example of an apparatus for treating clothes in accordance with the present invention now will be described more fully hereinafter with reference to the accompanying drawings. Although a drying machine will be described as an example of the clothes treating apparatus in the following preferred embodiments, the present invention is also applicable to clothes treating apparatuses of other types, for example, a washing machine, and a washing machine having a drying function (hereinafter, referred to as a "washing/drying machine").

In order to describe a drying machine according to an exemplary embodiment of the present invention, drying machines of a front loading type, an electric type, and a condensation type will be exemplified. Of course, the present invention is not limited to such types, and is applicable to drying machines of a top loading type, a gas type, and an exhaustion type.

Figure 1:
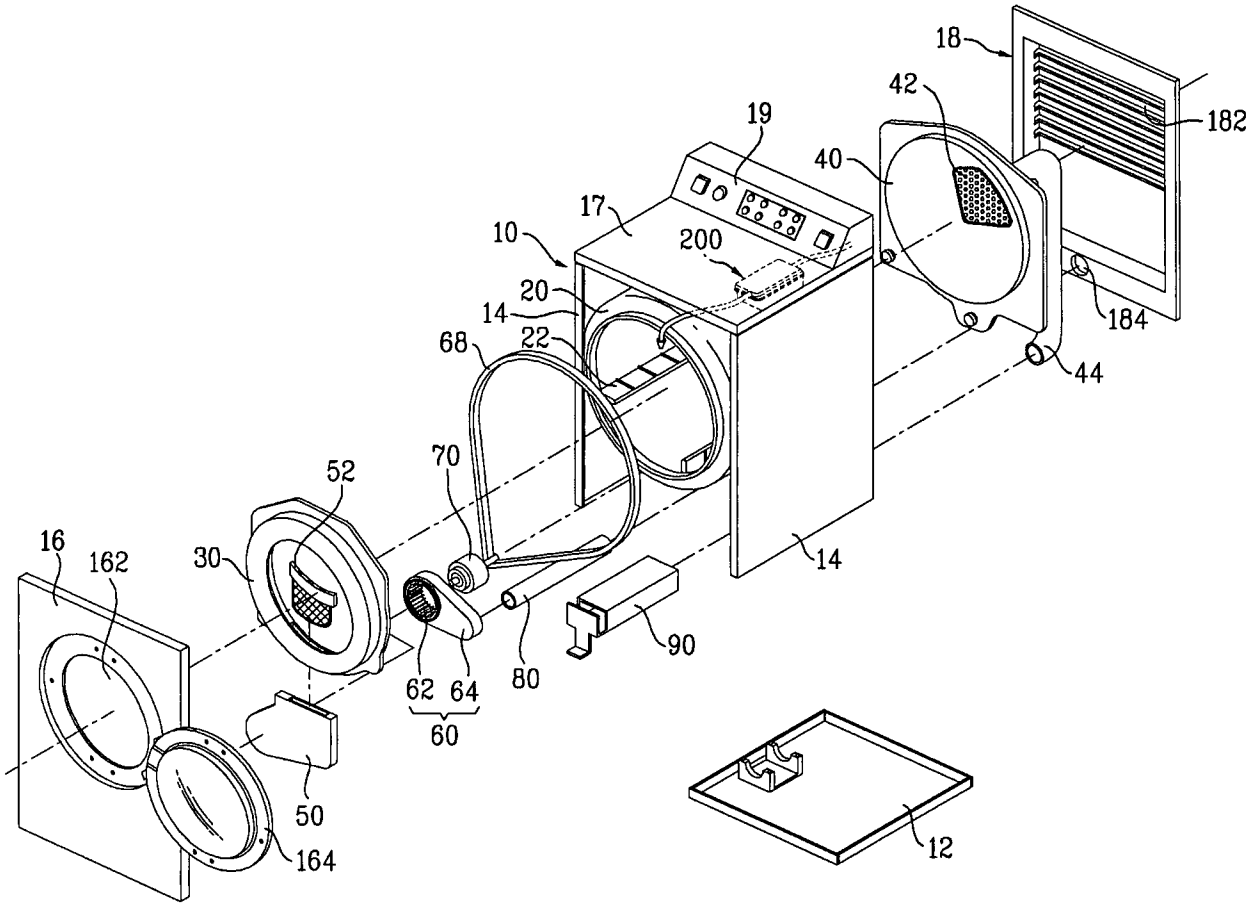
FIG. 1 is an exploded perspective view illustrating an exemplary embodiment of a drying machine according to the present invention.
Figure 2:
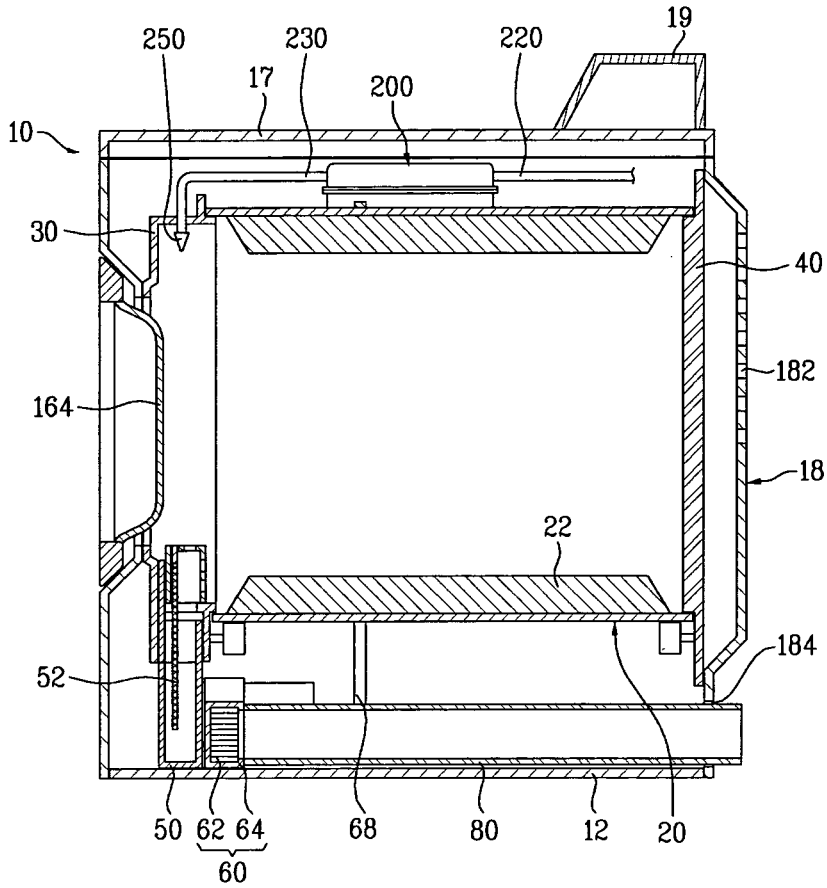
FIG. 2 is a vertical sectional view corresponding to FIG. 1.

Hereinafter, an exemplary embodiment of the drying machine according to the present invention will be described with reference to FIGS. 1 and 2.

In the interior of a cabinet 10 constituting an outer structure of the drying machine, a rotatable drum 20, and a motor 70 and a belt 68 for driving the drum 20 are installed.

A hot air supplier is arranged in the cabinet 10 at a desired position, to supply hot air to the drum 20. The hot air supplier may include a heater 90 for heating air, to generate high-temperature air (hereinafter, referred to as "hot air"), and a hot air supply duct 44 for supplying the hot air generated by the heater 90 to the drum 20. In the cabinet 10, an exhaust duct 80 for exhausting humid air heat-exchanged with objects to be dried in the drum 20, and a blower unit 60 for sucking the humid air are also arranged.

Meanwhile, a steam generator 200 is arranged in the cabinet at a desired position, to generate high-temperature steam. Although an indirect drive type, in which the motor 70 and belt 68 are used to rotate the drum 20, is described in this embodiment, the present invention is not limited thereto. That is, a direct drive type, in which a motor is directly connected to a rear wall of the drum 20, to directly rotate the drum 20, may be applied to the present invention.

Hereinafter, the above-described constituent elements will be described in more detail.

The cabinet 10, which forms the outer structure of the drying machine, includes a base 12 forming a bottom wall, a pair of side covers 14 extending vertically from the base 12, and a top cover 17 disposed on the upper ends of the side covers 14.

A control panel 19, which includes various operating switches or the like, is typically arranged on the top cover 17 or front cover 16. A door 164 is mounted to the front cover 16.

A louver 182 is provided at the rear cover 18, to introduce ambient air into the cabinet 10. An exhaust hole 184 is also provided at the rear cover 18, as a passage for finally discharging air from the drum 20 to the outside of the drum 20.

The interior of the drum 20 functions as a drying chamber, in which a drying operation is carried out. It is preferred that a lift 22 be installed in the drum 20, to drop laundry after raising the laundry such that the laundry is turned over, and thus to achieve an enhancement in drying efficiency.

Meanwhile, a front supporter 30 and a rear supporter 40 are installed between the drum 20 and the cabinet 10 (the front cover 16 and rear cover 18).

The drum 20 is rotatably installed between the front-supporter 30 and the rear supporter 40. Sealing members (not shown) are fitted between the front supporter 30 and the drum 20 and between the rear supporter 40 and the drum 20, respectively, to prevent fluid leakage.

That is, the front supporter 30 and rear supporter 40 close the front and rear ends of the drum 20, to define the drying chamber in the drum 20. The front supporter 30 and rear supporter 40 also function to support the front and rear ends of the drum 20.

An opening is formed through the front supporter 30, to communicate the drum 20 with the outside of the drying machine. The opening is selectively opened or closed by the door 164.

A lint duct 50, which is a passage for outwardly discharging air from the drum 20, is connected to the front supporter 30. A lint filter 52 is installed in the lint duct 50.

One side of the blower unit fan 60 is connected to the lint duct 50. The other side of the blower unit 60 is connected to the exhaust duct 80. The exhaust duct 80 communicates with an exhaust hole 184 provided at the rear cover 18.

Accordingly, when the blower unit 60 operates, air present in the drum 20 is exhausted from the drum 20 via the lint duct 50, exhaust duct 80, and exhaust hole 184. During this operation, foreign matter such as lint is filtered by the lint filter 52.

Typically, the blower fan 60 includes a blower 62, and a blower housing 64. Typically, the blower 62 is connected to the motor 70, which drives the drum 20.

An opening 42, which is constituted by a plurality of through holes, is formed at the rear supporter 40. A hot air supply duct 44 is connected to the opening 42.

The hot air supply duct 44 communicates with the drum 20, to function as a passage for supplying hot air to the drum 20. To this end, the heater 90 is installed at a certain position in the hot air supply duct 44.

Hereinafter, the configuration for supplying steam to the interior of the drum 20 will be described in detail.

Figure 3:
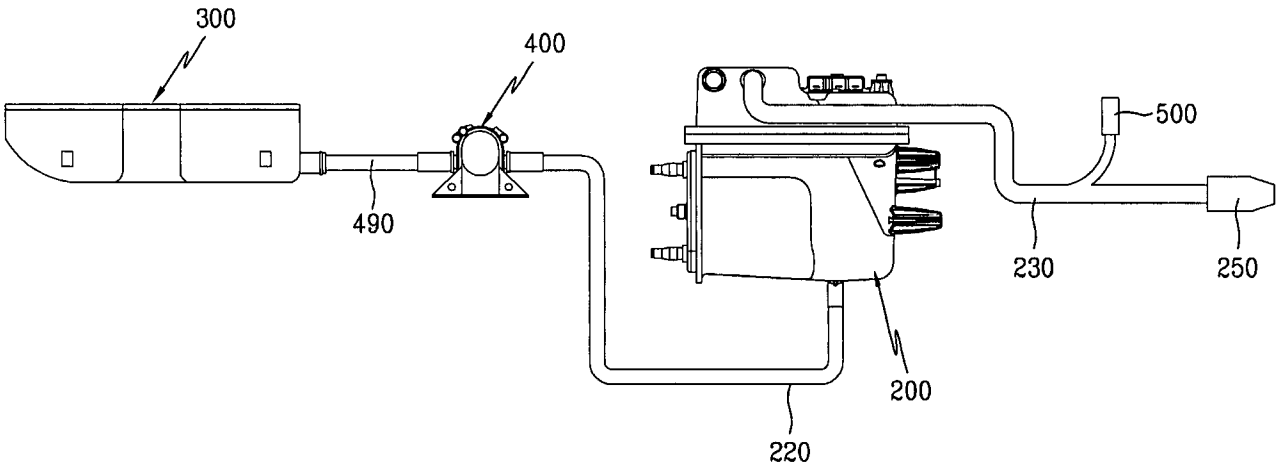
FIG. 3 is a view illustrating a steam generator and associated structures in the drying machine according to the present invention.

FIG. 3 is a view illustrating the steam generator and the structures associated with the stream generator.

Referring to FIG. 3, the steam generator 200, which is included in the drying machine according to the present invention, is arranged in the cabinet at a desired position, to supply steam to the interior of the drum 20.

The steam generator 200 includes a heater (not shown) installed in the interior of the steam generator 200, to heat water supplied thereto, and thus to supply steam into the interior of the drum 20.

Preferably, a safety valve 500 is arranged in a steam hose 230, which discharges steam from the steam generator 200. A nozzle 250 may also be provided at the steam hose 230, to spray steam into the drum 20.

The drying machine according to the present invention also includes a water container 300 to store water to be supplied to the steam generator 200. Preferably, the water container 300 is detachably mounted to the drying machine at a desired position.

Although the water supply source, which supplies water to the steam generator 200, may be a city water tap, there is a difficulty in connecting the steam generator 200 to the city water tap. This is because, in a typical drying machine, no water is used. That is, when the city water tap is used as a water supply source, it is necessary to additionally install various devices associated with the city water tap.

Therefore, there is a convenience when the detachable water container 300 is used as a water supply source for supply of water to the steam generator 200 such that water is supplied to the water container 300 in a detached state of the water container 300, and the water-filled water container 300 is then connected to the water supply line of the steam generator 200, namely, the water supply hose 220, as in the present embodiment.

The drying machine according to the present invention may further include a water supplier to supply water stored in the water container 300 to the steam generator 200. Preferably, the water supplier comprises a pump 400. It is also preferred that the pump 400 be arranged at a desired position in a water supply line 490, which connects the water container 300 to the steam generator 200. Preferably, the pump 400 is rotatable in normal and reverse directions, not only to supply water to the steam generator 200, but also to recover residual water from the steam generator 200.

Of course, it is possible to supply water to the steam generator 200, using a water head difference between the water container 300 and the steam generator 200, without using the pump 400.

However, a large part of the constituent elements of the drying machine are typically standardized products. Furthermore, the drying machine is designed to have a compact structure, so that there is no or little space for occupying any additional element.

For this reason, it is practically impossible to implement the water supply using a water head difference, without changing the sizes of the existing constituent elements of the drying machine. Therefore, it is useful to use the pump 400, which has a small size, as in the present embodiment, because it is possible to install the steam generator 200 without changing the sizes of the existing constituent elements of the drying machine, by virtue of the use of the small-size pump 400.

The reason why residual water is recovered from the steam generator 200 is that, when the steam generator 200 is not used for a prolonged period of time, the residual water may cause damage to the heater of the steam generator 200, or may be used in a decomposed state.

It is preferred that water be supplied to a lower portion of the steam generator 200, and steam be discharged from an upper portion of the steam generator 200, as shown in FIG. 3. Of course, water may be supplied to the upper portion of the steam generator 200, and steam may be discharged from the upper portion of the steam generator 200. In the latter case, there is an advantage in terms of the recovery of residual water from the steam generator 200.

Figure 4:
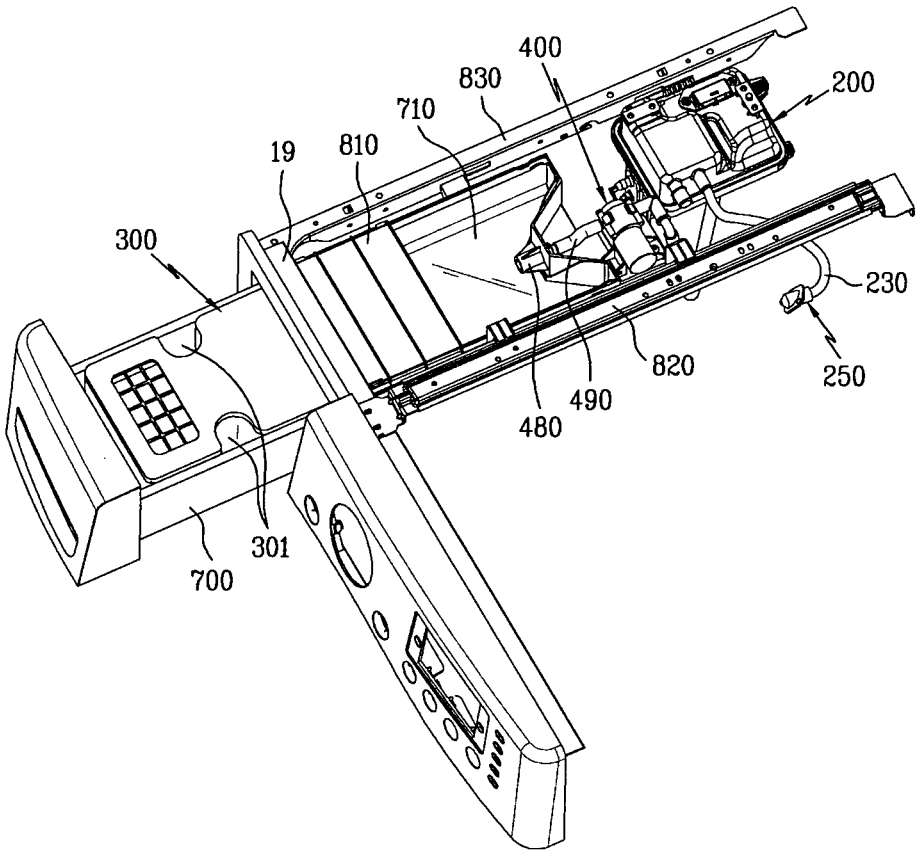
FIG. 4 is a perspective view illustrating an example of the arrangement of the constituent elements shown in FIG. 3.

FIG. 4 is a perspective view illustrating an example of the arrangement of the constituent elements shown in FIG. 3.

Referring to FIG. 4, the drying machine according to the illustrated embodiment of the present invention may further include a drawer type container 700 mounted in the drying machine at a desired position such that the draw type container 700 is slidably insertable/drawable. Hereinafter, the draw type container is simply referred to as a "drawer".

In this case, it is preferred that the water container 300 be detachably coupled to the water supply line 490 in an indirect manner by mounting the water container 300 in the drawer 700, and drawing the drawer 700 upon separating or coupling the water container 300 from or to the water supply line 490, as compared to a structure in which the water container 300 is directly connected to the water supply line 490. It is also preferred that the drawer 700 be arranged at the front side of the drying machine, for example, at the side of the control panel 19.

In detail, a supporter 820 is installed in the rear of the control panel 19. That is, the supporter 820 is arranged to be substantially parallel to a top frame 830. Preferably, a drawer guide 710 is arranged between the supporter 820 and the top frame 830, to guide and support the drawer 700. More preferably, a top guide 810 is arranged on a portion of the upper surface of the drawer guide 710.

The drawer guide 710 is open at the upper surface thereof and one side surface thereof (corresponding to the front side of the drying machine). The drawer 700 is insertable/drawable through an opening formed through the side surface of the drawer guide 710. Preferably, the water supply line 490 is arranged on the upper surface of the drawer guide 710 opposite to the opening.

As described above, it is desirable for the drawer 700 to be installed at the front side of the drying machine, in terms of the convenience of use. In this regard, in the drying machine of FIG. 4, in which the control panel 19 is arranged on the front cover, the drawer 700 is installed such that it is insertable and drawable through the control panel 19.

However, the present invention is not limited to such an arrangement. For example, where the control panel is arranged on the top cover, it is possible to install the drawer 700 directly through the front cover.

In another embodiment, the drawer 700 itself may be used as the water container 300. In this case, the drawer 700 is configured to be detachable from the drying machine. Where the drawer 700 itself is used as the water container 300, it is possible to achieve a simplified structure.

Hereinafter, connection and control configurations for the water container 300 and pump 400 will be described in detail with reference to FIGS. 5 to 7.

Figure 5:
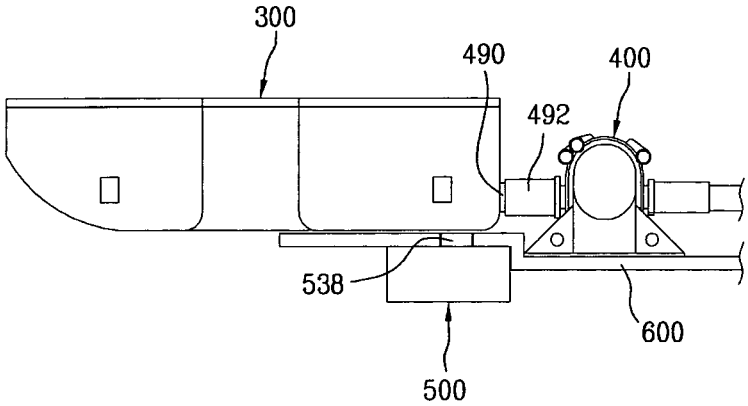
FIG. 5 is a side view schematically illustrating a state in which a water container and a pump in the drying machine according to the present invention are in a connected state.

FIG. 5 is a side view schematically illustrating a state in which the water container and the pump in the drying machine according to the present invention are in a connected state. FIG. 6 is a side view schematically illustrating a state in which the water container and the pump in the drying machine according to the present invention are in a separated state. FIG. 7 is a block diagram schematically illustrating a control configuration of the drying machine according to the present invention.

Figure 6:
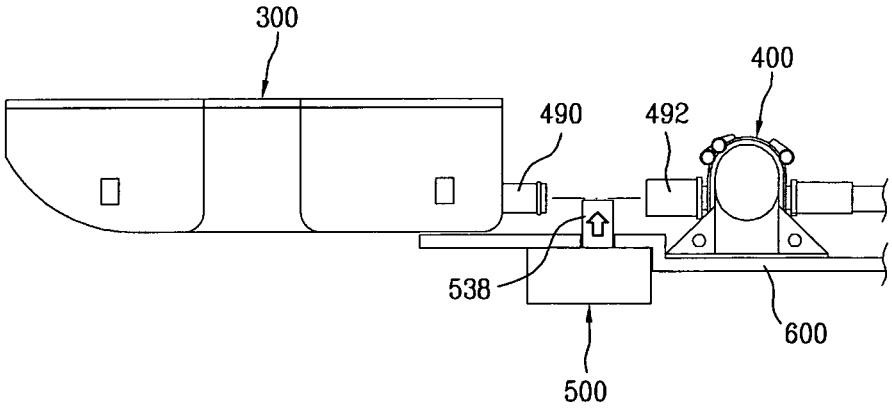
FIG. 6 is a side view schematically illustrating a state in which the water container and the pump in the drying machine according to the present invention are in a separated state.
Figure 7:
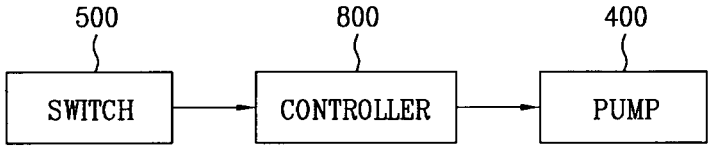
FIG. 7 is a block diagram schematically illustrating a control configuration of the drying machine according to the present invention.

Referring to FIGS. 5 to 7, the drying machine according to the present invention includes a sensor 500 to sense whether the water container 300 is detached or attached, and a controller 800 for controlling an operation of the pump 400 based on the sensing results of the sensor 500.

It is preferred that the operation of the pump 400 be controlled by the controller 800 based on whether the water container 300 is in a detached state or in a attached state, as described above. For example, it is possible to prevent waste of electric power caused by an unnecessary operation of the pump 400, by stopping the pump 400, which is in operation, when the water container 300 is detached, and again operating the pump 400 when the water container 300 is coupled, under the control of the controller 800. This is because it is unnecessary to operate the pump 400 in the detached state of the water container 300.

Preferably, the controller 800 controls the pump 400 to operate for a predetermined time, even when the sensor 500 senses a detachment of the water container 300. That is, it is preferred that, when the controller 800 detects a detachment of the water container 300 through the sensor 500, it does not instruct the pump 400 to stop immediately, but controls the pump 400 to stop after further operating for a pre-determined time.

When the water container 300 is detached from the drying machine, the water remaining in the water supply line 490 may leak into the interior of the drying machine. Accordingly, when the controller 800 controls the pump 400 to operate for a predetermined time upon detecting the detachment of the water container 300, the water remaining in the water supply line 490 can be completely supplied to the steam generator 200. As a result, it is possible to prevent the leakage of water into the interior of the drying machine. Thus, it is possible to prevent the leakage of electricity and the malfunction of the drying machine possibly caused by the leakage of the water remaining in the water supply line 490 into the interior of the drying machine.

Meanwhile, the drying machine according to this embodiment further includes a pump bracket 600, to which the pump 400 is mounted. The water supply line 490, which is included in the water container 300, is connected to the pump 400. In this case, it is preferred that the connection between the pump 400 and the water supply line 490 be achieved by a clamp 492, as shown in FIGS. 5 and 6.

Preferably, the sensor 500 is arranged beneath the pump bracket 600 near a region where the water supply line 490 is connected to the pump 400. In this case, it is possible to reliably sense the disconnection/connection of the water container 300 from/to the pump 400 every time the disconnection/connection of the water container 300 occurs.

The sensor 500 may comprise an on/off switch, which turns on or off based on the connection or disconnection state of the water container 300 and pump 400.

When the water container 300 is connected to the pump 400, as shown in FIG. 5, a button 538 of the switch 500 is pressed. On the other hand, when the water container 300 is disconnected from the pump 400, as shown in FIG. 6, the button 580 of the switch 500 returns to an original state thereof. Accordingly, it is possible to enable the controller 800 to detect the ON/OFF state of the switch 500 by setting the pressed state to correspond to the ON state, and setting the returned state to correspond to the OFF state.

That is, the switch 500 may be configured to send an electrical signal representing the ON/OFF state to the controller 800. The controller may be configured to send a control signal to the pump 400 in response to the received signal, and thus to control the pump 400.

In more detail, when the water container 300 is detached, namely, is disconnected from the pump 400, the switch 500, which is the sensor, operates to send a corresponding electrical sensing signal to the controller 800.

When the controller 800 determines that the water container 300 is a detached state, based on the electrical sensing signal, it controls the pump to operate for a pre-determined time, in order to allow residual water, which remains in the water supply line 490 upon the detachment of the water container 300, to be supplied to the steam generator 200. Accordingly, it is possible to prevent the residual water from flowing into the interior of the drying machine.

In another embodiment, the sensor 500 may comprise a sensor capable of sensing the connection or disconnection state of the pump 400 and water container 300.

That is, a sensor may be attached to the pump bracket 600, water container 300, or water supply line 490. In this case, it is possible to sense the detachment or attachment of the water container 300 by sensing a movement of the sensor.

Hereinafter, a method for controlling the drying machine having the above-described configuration will be described.

In accordance with an exemplary embodiment of the present invention, the drying machine control method may include sensing whether the water container 300 is in a detached state or in a coupled state, and controlling an operation of the pump 400 based on the results of the sensing.

The controlling step may include controlling the pump 400 to stop when the detachment of the water container 300 is sensed during the operation of the pump 400, and controlling the pump 400 to re-operate when the water container 300 is attached.

Preferably, the controlling step may include controlling the pump 400 to operate for a predetermined time when the water container 300 is detached. In this case, it is possible to prevent residual water, which remains in the water supply line 490 upon the detachment of the water container 300, from leaking.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The drying machine configured as described above in accordance with the present invention has the following effects.

First, in accordance with the present invention, it is possible to effectively prevent the formation of creases on clothes or to effectively remove the formed creases.

Second, in accordance with the present invention, it is possible to effectively remove creases formed on clothes, without performing ironing.

Third, in accordance with the present invention, it is possible to prevent residual water, which remains in the water supply line upon the detachment of the water container from the pump, from leaking, and thus to prevent the leakage of electricity and the malfunction of the drying machine possibly caused by the leakage of the water remaining in the water supply line.

The invention claimed is:

1. An apparatus for treating clothes comprising:

a cabinet;

a rotatable drum;

a steam generator to supply steam to the drum;

a drawer arranged at a side of a control panel;

a water container to store water to be supplied to the steam generator, the water container detachably placed in the drawer;

a water supplier to supply water stored in the water container to the steam generator;

a water supply line to connect the water container and the steam generator;

a sensor to sense a connection or disconnection state of the water supplier and the water container; and a controller to control an operation of the water supplier based on a sensing result of the sensor, wherein the drawer is pushed in/pulled out of the control panel, wherein when the drawer is pushed in the control panel, the water supply line is coupled with the water container, and wherein when the drawer is pulled out of the control panel, the water supply line is separated from the water container and the water container in the drawer is separable from the drawer.

2. The apparatus according to claim 1, wherein the water supplier comprises a pump.

3. The apparatus according to claim 2, wherein the pump is arranged in the water supply line, the water supply line connecting the steam generator and the water container.

4. The apparatus according to claim 2, wherein the sensor comprises an on/off switch which turns on or off based on a connection or disconnection between the pump and the water container.

5. The apparatus according to claim 2, wherein the sensor comprises a sensor capable of sensing a connection or disconnection between the pump and the water container.

6. A drying machine comprising:

a cabinet;

a rotatable drum;

a hot air supplier to supply hot air to the drum;

a steam generator to supply steam to the drum;

a drawer arranged at a side of a control panel;

a water container to store water to be supplied to the steam generator, the water container detachably placed in the drawer;

a water supplier to supply water stored in the water container to the steam generator and to recover residual water from the steam generator;

a sensor to sense a connection or disconnection state of the water supplier and the water container; and a controller to control an operation of the water supplier based on a sensing result of the sensor, wherein the controller controls the water supplier to operate until the water remaining in a water supply line is supplied to the steam generator when the detachment of the water container is sensed by the sensor, wherein the water supplier is arranged in a water supply line which connects the water container to the steam generator, the water supply line connected to a lower portion of the steam generator, wherein the drawer is pushed in/pulled out of the control panel, where in the drawer is pushed in the control panel, the water supply line Is coupled with the water container, and wherein when the drawer is pulled out of the control panel, the water supply line is separated from the water container and the water container in the drawer is separable from the drawer.

7. The drying machine according to claim 6, wherein the water supplier comprises a pump.

8. The drying machine according to claim 7, wherein the pump is arranged in the water supply line, the water supply line connecting the steam generator and the water container.

9. The drying machine according to claim 7, wherein the sensor comprises an on/off switch which turns on or off based on a connection or disconnection between the pump and the water container.

10. The drying machine according to claim 7, wherein the sensor comprises a sensor capable of sensing a connection or disconnection between the pump and the water container.

11. The apparatus according to claim 1, wherein the controller controls the water supplier to operate until the water remaining in the water supply line is supplied to the steam generator when the detachment of the water container is sensed by the sensor.

* * * * *